US011295577B2

(12) United States Patent
Kashif

(10) Patent No.: US 11,295,577 B2
(45) Date of Patent: Apr. 5, 2022

(54) COMPUTER SYSTEM FOR ENABLING PLACEMENT OF WAGERS

(71) Applicant: Tik Tok Technologies Ltd, Coventry (GB)

(72) Inventor: Tunch Kashif, London (GB)

(73) Assignee: Tik Tok Technologies Ltd, Coventry (GB)

( * ) Notice: Subject to any disclaimer, the term of this patent is extended or adjusted under 35 U.S.C. 154(b) by 0 days.

(21) Appl. No.: 16/527,698

(22) Filed: Jul. 31, 2019

(65) Prior Publication Data

US 2021/0035414 A1 Feb. 4, 2021

(51) Int. Cl.
*G07F 17/32* (2006.01)

(52) U.S. Cl.
CPC ..... *G07F 17/3288* (2013.01); *G07F 17/323* (2013.01); *G07F 17/3211* (2013.01)

(58) Field of Classification Search
CPC . G07F 17/3288; G07F 17/3211; G07F 17/323
See application file for complete search history.

(56) References Cited

U.S. PATENT DOCUMENTS 6,126,543 A * 10/2000 Friedman ..... A63F 3/00157 273/139
9,773,382 B1 * 9/2017 Korner ..... G07F 17/3288
2005/0003888 A1 * 1/2005 Asher ..... G07F 17/3288 463/25
2008/0176643 A1 * 7/2008 Phillips ..... G07F 17/3272 463/25
2009/0111552 A1 * 4/2009 Inamura ..... G07F 17/3262 463/16
2011/0256925 A1 * 10/2011 Schipani ..... G06Q 50/34 463/28
2012/0058813 A1 * 3/2012 Amaitis ..... G07F 17/3269 463/25
2014/0274311 A1 * 9/2014 Aronowitz ..... G06Q 30/06 463/25
2018/0033251 A1 * 2/2018 Beyer ..... G07F 17/3227
2018/0047254 A1 * 2/2018 Acton ..... G06Q 50/34

FOREIGN PATENT DOCUMENTS

GB 2559098 A 8/2018

* cited by examiner

*Primary Examiner* — Omkar A Deodhar
*Assistant Examiner* — Shauna-Kay Hall
(74) *Attorney, Agent, or Firm* — Blueshift IP, LLC; Robert Plotkin

(57) ABSTRACT

Users will often want to calculate odds for a variety of combinations of events to establish a favourable/desired amount of risk in order to place a wager. Regrettably, odds produced by bookmakers often change with sufficient frequency that it is not possible for a user to calculate all the possible odds for a variety of combinations of events before the odds produced by a bookmaker change, thus invalidating their calculations. The invention provides a computer system for enabling placement of wagers that calculates a plurality of combined odds, each of the combined odds comprising a combination of events with corresponding selected outcome types. In this way, users may place combination wagers on the outcomes of a combination of events in an informed manner; that is, being aware of the combined odds and alternative combined odds available.

2 Claims, 22 Drawing Sheets

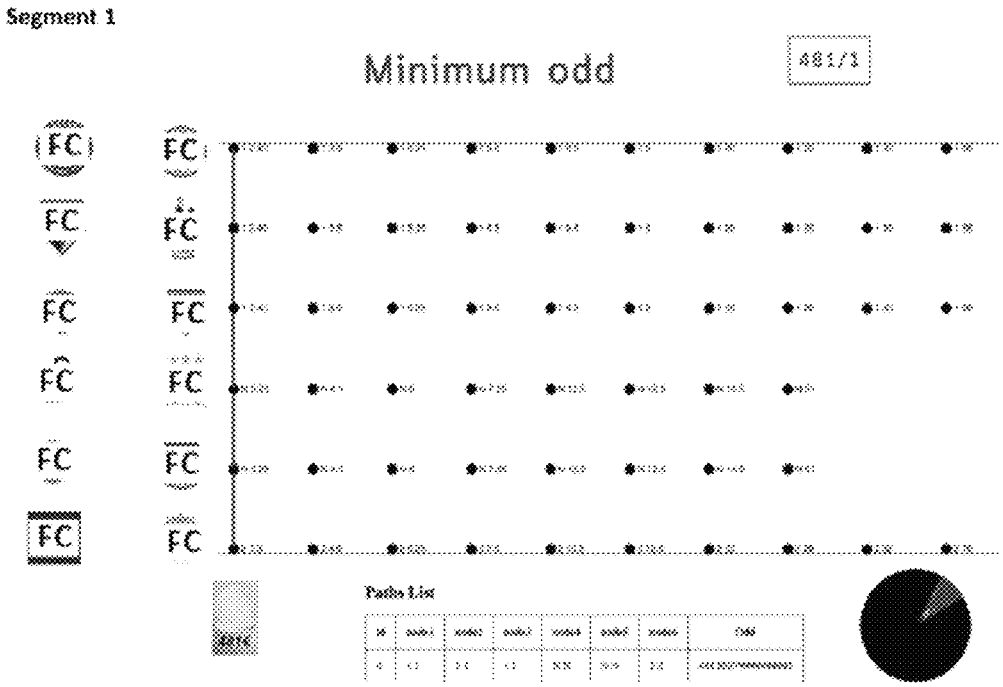

| | |
|---|---|
| Segment 1 | 2.4 /1 |
| Minimum | X 2.4 /1 |
| Odds Group | X 2.4 /1 |
| | X 3.25 /1 |
| | X 3.25 /1 |
| | X 3.3 /1 |

= 481 / 1

Explanation

The Minimum Odds Group Pathway is displayed in the Minimum Odds Group Segment 1 as depicted. This shows how much the minimum combined odds group of 6 when multiplied provides a 481/1 return for a unit stake.

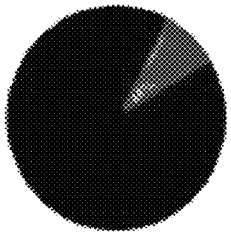

| | | |
|---|---|---|
| | 2.4 /1 | 1 - Home Win |
| X | 2.4 /1 | 1 - Home Win |
| X | 2.4 /1 | 1 - Home Win |
| X | 3.25 /1 | N - Draw |
| X | 3.25 /1 | N - Draw |
| X | 3.3 /1 | 2 - Away Win |
| = | 481 /1 | |

There is no lower paying odds group than the Minimum Odds Group based on the 6 selections having been made.

FIG.4

Segment 2
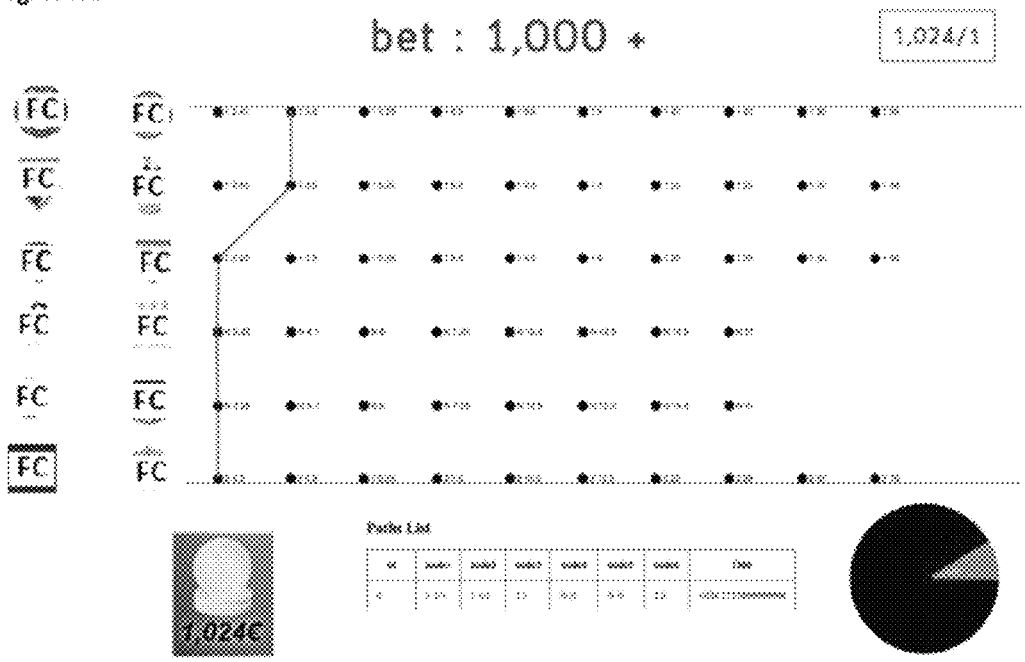
| | |
|---|---|
| Segment 2 | 3.5 /1 |
| 1,000/1 + | X 3.5 /1 |
| Odds Group | X 2.4 /1 |
| | X 3.25 /1 |
| | X 3.25 /1 |
| | X 3.3 /1 |
≈ 1,024.7 / 1
Explanation
The 1,000/1 + Odds Group Pathway is displayed in the 1,000/1 + Odds Group Segment 2 as depicted. This shows how much the 1,000/1 + combined odds group of 6 when multiplied provides a 1,024/1 return for a 1 unit stake.
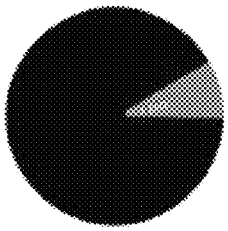
| | |
|---|---|
| 3.5 /1 | 1 - Home Win |
| X 3.5 /1 | 1 - Home Win |
| X 2.4 /1 | 1 - Home Win |
| X 3.25 /1 | N - Draw |
| X 3.25 /1 | N - Draw |
| X 3.3 /1 | 2 - Away Win |
≈ 1,024.7 / 1
The 1,000/1 + Odds Group based on the 6 selections having been made.
FIG.5

Segment 3

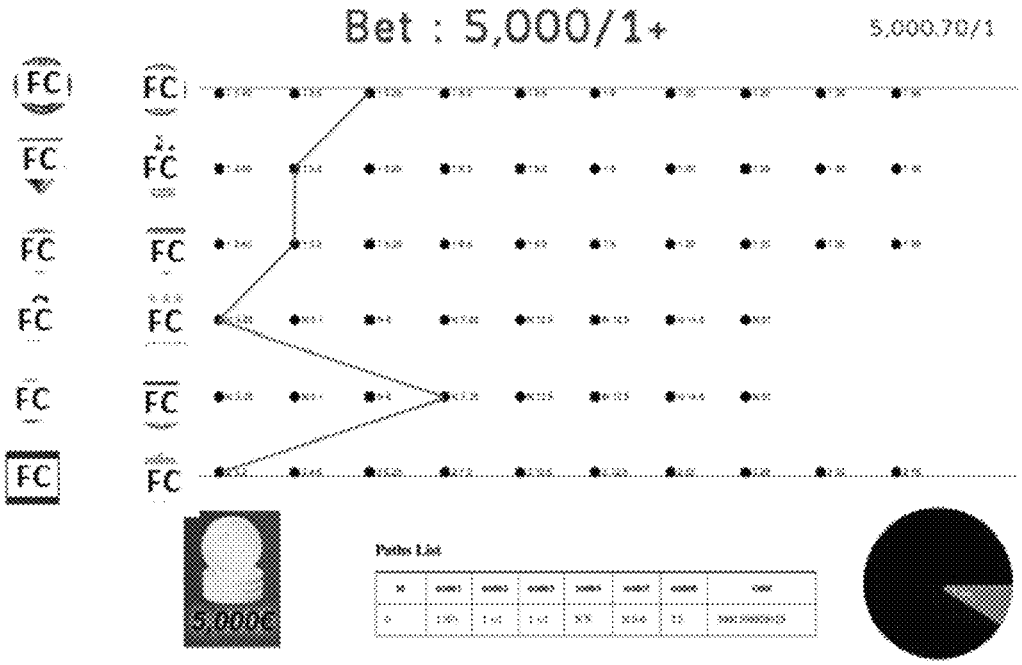

| | | |
|---|---|---|
| Segment 3<br>5,000/1 +<br>Odds Group | 3.5 /1<br>X 3.5 /1<br>X 5.25 /1<br>X 3.25 /1<br>X 7.25 /1<br>X 3.3 /1 | = 5,000.7 / 1 |

Explanation

The 5,000/1 + Odds Group Pathway is displayed in the 5,000/1 + Odds Group Segment 3 as depicted. This shows how much the 5,000/1 + combined odds group of 6 when multiplied provides a 5,000/1 return for a 1 unit stake.

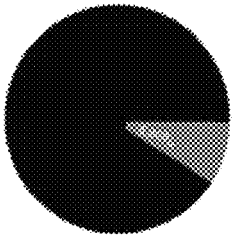

| | |
|---|---|
| 3.5 /1 | 1 - Home Win |
| X 3.5 /1 | 1 - Home Win |
| X 5.25 /1 | 1 - Home Win |
| X 3.25 /1 | N - Draw |
| X 7.25 /1 | N - Draw |
| X 3.3 /1 | 2 - Away Win |

= 5,000.7 / 1

The 5,000/1 + Odds Group based on the 6 selections having been made.

FIG.6

Segment 4
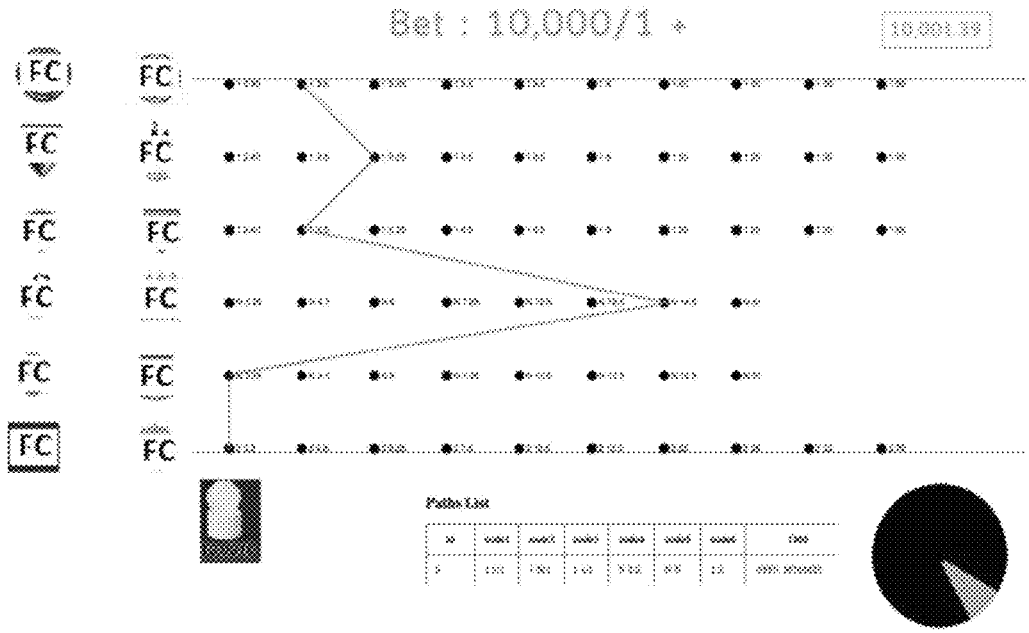
| | | |
|---|---|---|
| Segment 4 | 3.5 /1 | |
| 10,000/1 + | X 3.5 /1 | |
| Odds Group | X 5.25 /1 | = 10,001.4 / 1 |
| | X 3.25 /1 | |
| | X 14.5 /1 | |
| | X 3.3 /1 | |
Explanation
The 10,000/1 + Odds Group Pathway is displayed in the 10,000/1 + Odds Group Segment 3 as depicted. This shows how much the 10,000/1 + combined odds group of 6 when multiplied provides a 10,000/1 + return for a 1 unit stake.
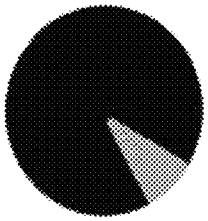
| | |
|---|---|
| 3.5 /1 | 1 - Home Win |
| X 3.5 /1 | 1 - Home Win |
| X 5.25 /1 | 1 - Home Win |
| X 3.25 /1 | N - Draw |
| X 14.5 /1 | N - Draw |
| X 3.3 /1 | 2 - Away Win |
= 10,001.4 / 1
The 10,000/1 + Odds Group based on the 6 selections having been made.
FIG.7

Segment 5
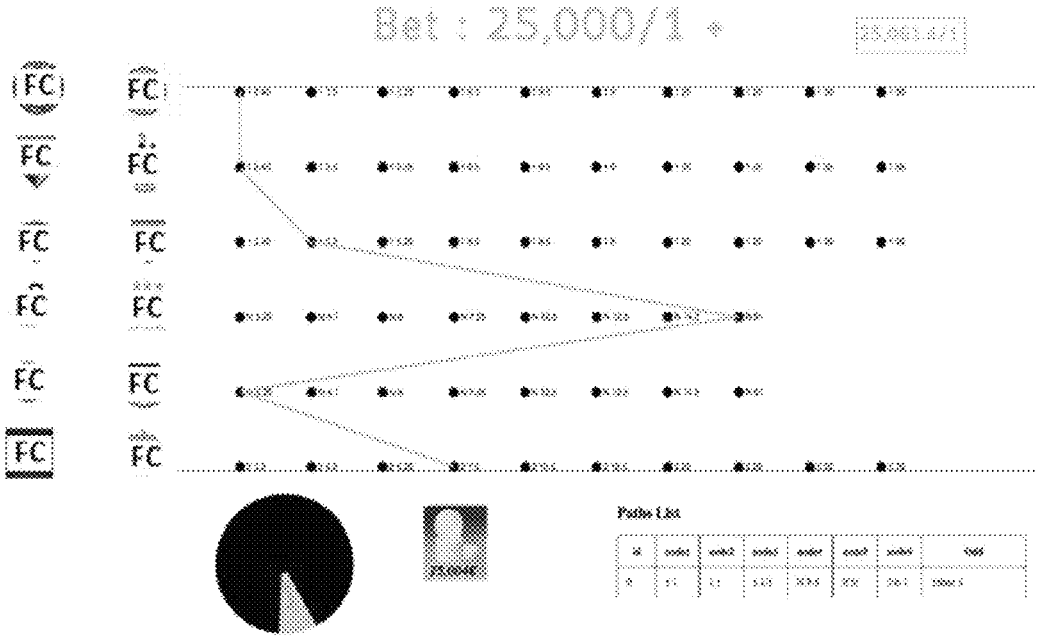
| | | |
|---|---|---|
| Segment 5 | 2.4 /1 | |
| 25,000/1 + | X 5.25 /1 | |
| Odds Group | X 5.25 /1 | = 25,004.7 / 1 |
| | X 6 /1 | |
| | X 6 /1 | |
| | X 10.5/1 | |
Explanation
The 25,000/1 + Odds Group Pathway is displayed in the 25,000/1 + Odds Group Segment 3 as depicted. This shows how much the 25,000/1 + combined odds group of 6 when multiplied provides a 25,000/1 + return for a 1 unit stake.
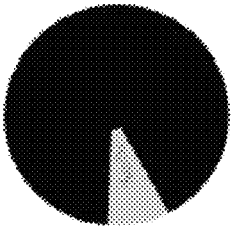
| | |
|---|---|
| 2.4 /1 | 1 - Home Win |
| X 5.25 /1 | 1 - Home Win |
| X 5.25 /1 | 1 - Home Win |
| X 6 /1 | N - Draw |
| X 6 /1 | N - Draw |
| X 10.5 /1 | 2 - Away Win |
= 25,004.7 / 1
The 25,000/1 + Odds Group based on the 6 selections having been made.
FIG.8

Segment 6
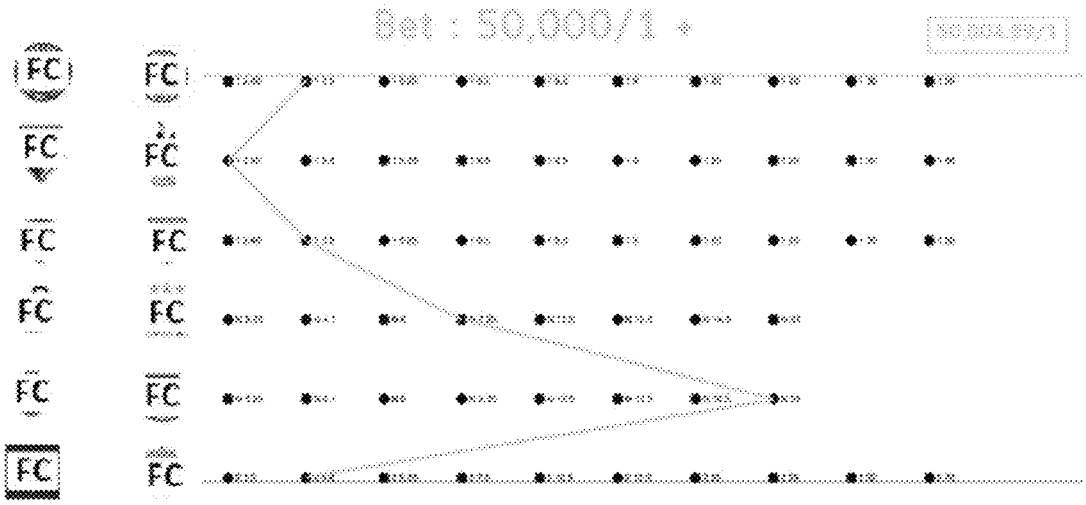
Segment 6
50,000/1 +
Odds Group
2.4 /1
X 3.5 /1
X 3.5 /1
X 7.25/1
X 51 /1
X 4.5 /1
= 50,004.1 / 1
Explanation
The 50,000/1 + Odds Group Pathway is displayed in the 50,000/1 + Odds Group Segment 3 as depicted. This shows how much the 50,000/1 + combined odds group of 6 when multiplied provides a 50,000/1 + return for a 1 unit stake.
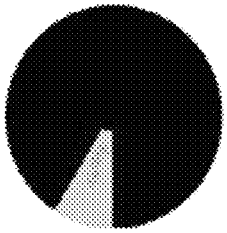
| | |
|---|---|
| 2.4 /1 | 1 - Home Win |
| X 3.5 /1 | 1 - Home Win |
| X 3.5 /1 | 1 - Home Win |
| X 7.25/1 | N - Draw |
| X 51 /1 | N - Draw |
| X 4.5 /1 | 2 - Away Win |
= 50,004.1 / 1
The 50,000/1 + Odds Group based on the 6 selections having been made.
FIG.9

Segment 7

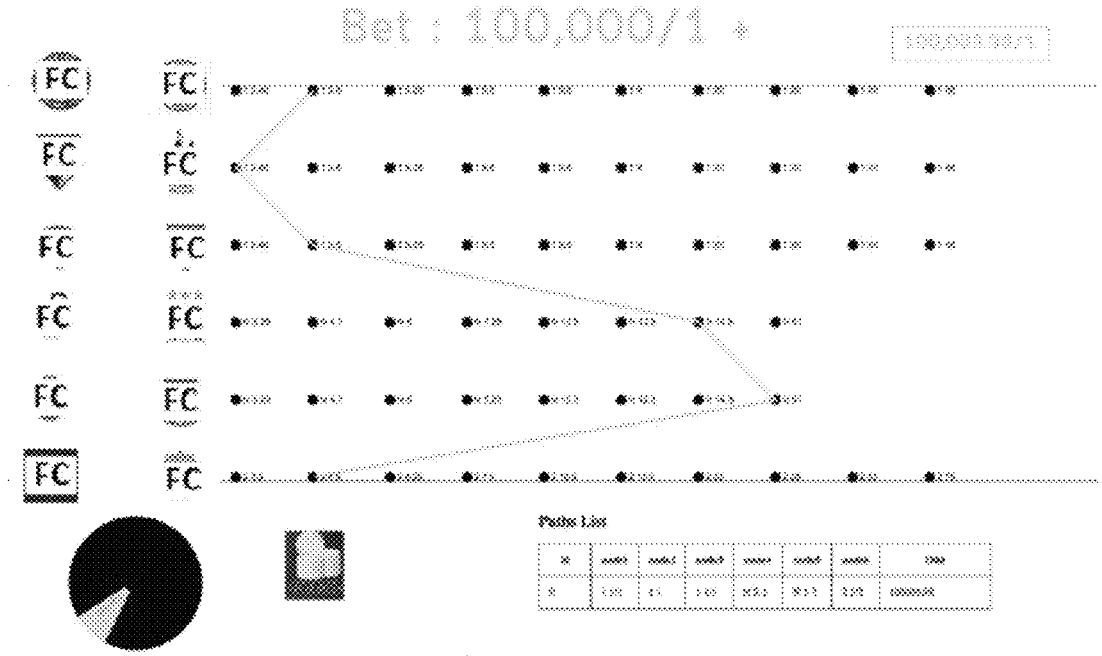

| | | |
|---|---|---|
| Segment 7<br>100,000/1 +<br>Odds Group | 2.4 /1<br>X 3.5 /1<br>X 3.5 /1<br>X 14.5 /1<br>X 51 /1<br>X 4.6 /1 | = 100,001 / 1 |

Explanation

The 100,000/1 + Odds Group Pathway is displayed in the 100,000/1 + Odds Group Segment 3 as depicted. This shows how much the 100,000/1 + combined odds group of 6 when multiplied provides a 100,000/1 + return for a 1 unit stake.

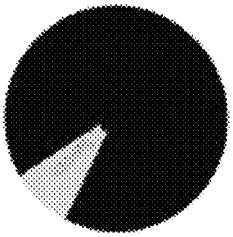

| | |
|---|---|
| 2.4 /1 | 1 - Home Win |
| X 3.5 /1 | 1 - Home Win |
| X 3.5 /1 | 1 - Home Win |
| X 14.5 /1 | N - Draw |
| X 51 /1 | N - Draw |
| X 4.6 /1 | 2 - Away Win |

= 100,001 / 1

The 100,000/1 + Odds Group based on the 6 selections having been made.

FIG.10

Segment 8
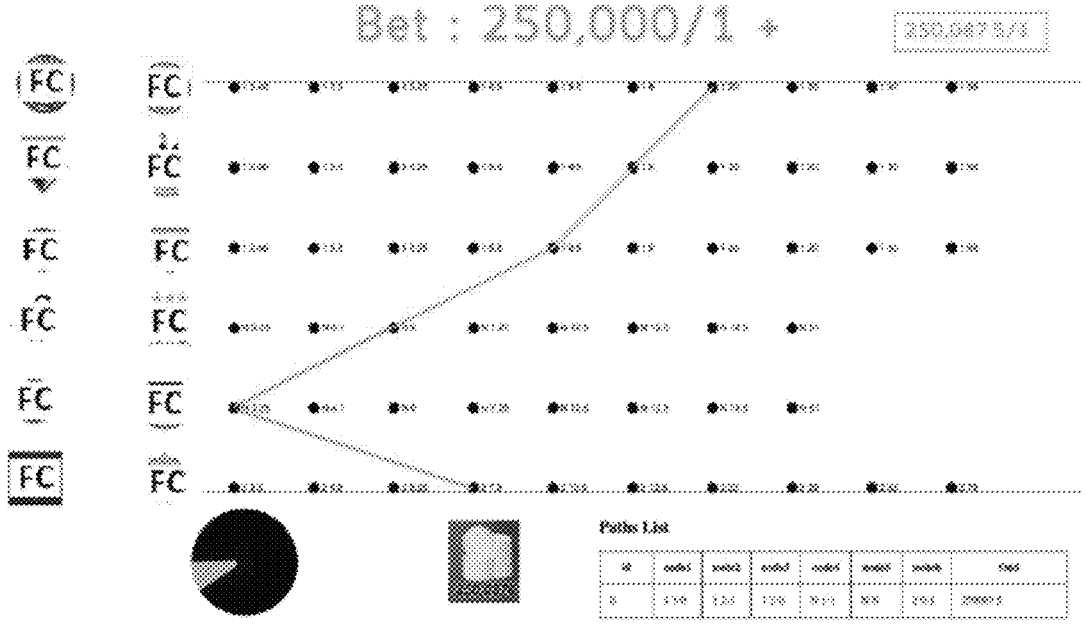
| | | |
|---|---|---|
| Segment 8 | 6.5 /1 | |
| 250,000/1 + | X 9.5 /1 | |
| Odds Group | X 7 /1 | = 250,087 / 1 |
| | X 6 /1 | |
| | X 6 /1 | |
| | X 12.5 /1 | |
Explanation
The 250,000/1 + Odds Group Pathway is displayed in the 250,000/1 + Odds Group Segment 3 as depicted. This shows how much the 250,000/1 + combined odds group of 6 when multiplied provides a 250,000/1 + return for a 1 unit stake.
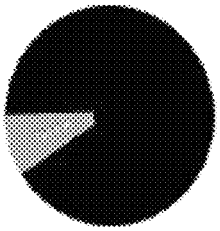
| | | |
|---|---|---|
| 6.5 | /1 | 1 - Home Win |
| X 9.5 | /1 | 1 - Home Win |
| X 7 | /1 | 1 - Home Win |
| X 6 | /1 | N - Draw |
| X 6 | /1 | N - Draw |
| X 12.5 | /1 | 2 - Away Win |
= 250,087 / 1
The 250,000/1 + Odds Group based on the 6 selections having been made.
FIG.11

Segment 9
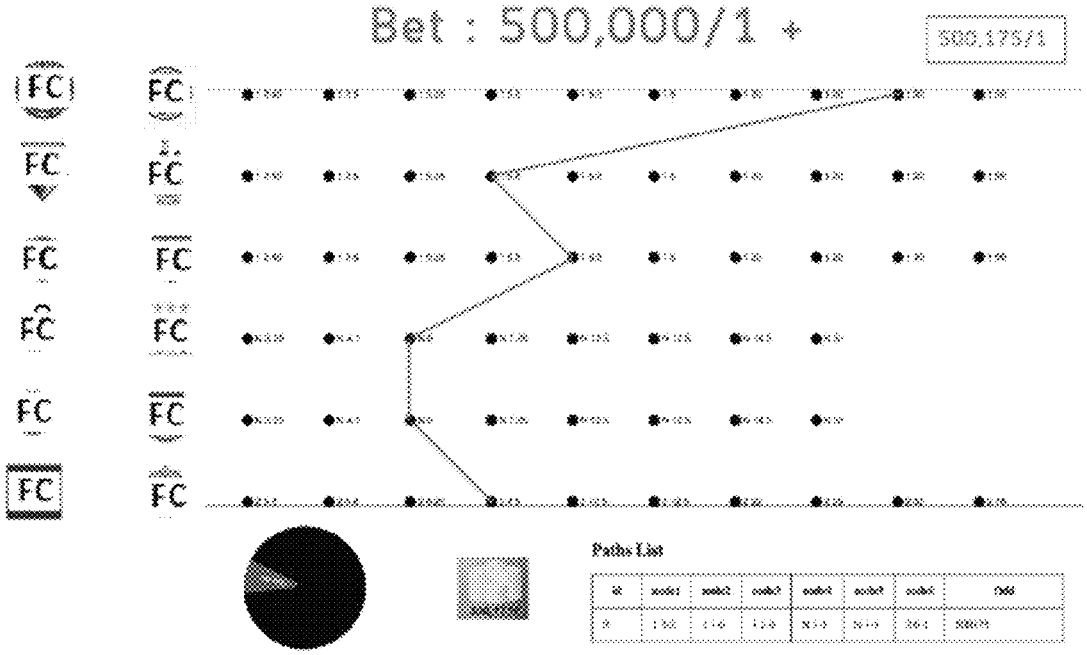
| | | |
|---|---|---|
| Segment 9 | 6.5 /1 | |
| 500,000/1 + | X 9.5 /1 | |
| Odds Group | X 30 /1 | = 500,175 / 1 |
| | X 6 /1 | |
| | X 6 /1 | |
| | X 75 /1 | |
Explanation
The 500,000/1 + Odds Group Pathway is displayed in the 500,000/1 + Odds Group Segment 3 as depicted. This shows how much the 500,000/1 + combined odds group of 6 when multiplied provides a 500,000/1 + return for a 1 unit stake.
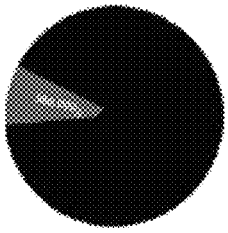
| | | |
|---|---|---|
| 6.5 | /1 | 1 - Home Win |
| X 9.5 | /1 | 1 - Home Win |
| X 30 | /1 | 1 - Home Win |
| X 6 | /1 | N - Draw |
| X 6 | /1 | N - Draw |
| X 75 | /1 | 2 - Away Win |
= 500,175 / 1
The 500,000/1 + Odds Group based on the 6 selections having been made.
FIG.12

Segment 10

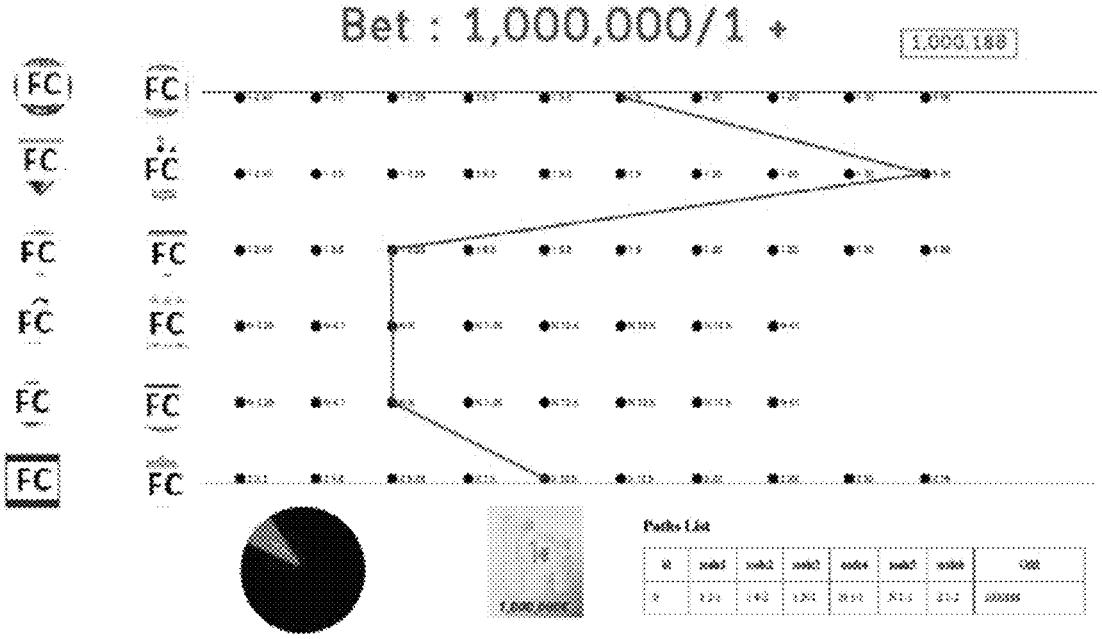

| | | |
|---|---|---|
| Segment 10 | 5.25 /1 | |
| 1,000,000/1 + | X 9 /1 | |
| Odds Group | X 56 /1 | = 1,000,188 / 1 |
| | X 6 /1 | |
| | X 6 /1 | |
| | X 10.5 /1 | |

Explanation

The 1,000,000/1 + Odds Group Pathway is displayed in the 1,000,000/1 + Odds Group Segment 3 as depicted. This shows how much the 1,000,000/1 + combined odds group of 6 when multiplied provides a 1,000,000/1 + return for a 1 unit stake.

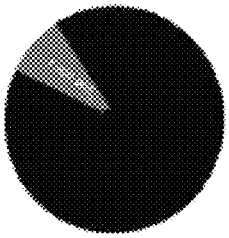

| | |
|---|---|
| 5.25 /1 | 1 - Home Win |
| X 9 /1 | 1 - Home Win |
| X 56 /1 | 1 - Home Win |
| X 6 /1 | N - Draw |
| X 6 /1 | N - Draw |
| X 10.5 /1 | 2 - Away Win |

= 1,000,188 / 1

There is no higher paying odds group than the 1,000,188 / 1 Odds Group based on the 6 selections having been made.

FIG.13

| Home | win odds | Draw | odds | Away | win odds | Results order |
|---|---|---|---|---|---|---|
| 1 | 2.40 | N | 3.25 | 2 | 3.3 | 1 |
| 1/1 | 3.5 | N/N | 4.1 | 2/2 | 4.6 | 1 |
| N/1 | 5.25 | 1-1 | 6 | N/2 | 6.25 | 1 |
| 1-0 | 6.5 | 0-0 | 7.25 | 0-1 | 7.5 | N |
| 2-0 | 9.5 | 1/N | 12.5 | 1-2 | 10.5 | N |
| 2-1 | 9 | 2/N | 12.5 | 0-2 | 12.5 | 2 |
| 3-0 | 20 | 2-2 | 14.5 | 1/2 | 22 | |
| 2/1 | 20 | 3-3 | 51 | 0-3 | 29 | |
| 3-2 | 30 | | | 2-3 | 32 | |
| 4-2 | 56 | | | 2-4 | 76 | |

| | |
|---|---|
| Number of paths (max) | 640000 |
| Min odds | 0 |
| Max odds | 1000 |
| Number of paths found | 21 |
| Index of path to draw | all |

Compute paths

Paths List

| id | node1 | node2 | node3 | node4 | node5 | node6 | Odd |
|---|---|---|---|---|---|---|---|
| 0 | 1 1 | 1 1 | 1 1 | N N | N N | 2 2 | 481.85279999999995 |
| 1 | 1 1 | 1 1 | 1 1 | N N | N N/N | 2 2 | 607.8758399999999 |
| 2 | 1 1 | 1 1 | 1 1 | N N/N | N N | 2 2 | 607.8758399999999 |

• Group min odds - 1000/1

| Home | win odds | Draw | odds | Away | win odds | Results order |
|---|---|---|---|---|---|---|
| 1 | 2.40 | N | 3.25 | 2 | 3.3 | 1 |
| 1/1 | 3.5 | N/N | 4.1 | 2/2 | 4.6 | 1 |
| N/1 | 5.25 | 1-1 | 6 | N/2 | 6.25 | 1 |
| 1-0 | 6.5 | 0-0 | 7.25 | 0-1 | 7.5 | N |
| 2-0 | 9.5 | 1/N | 12.5 | 1-2 | 10.5 | N |
| 2-1 | 9 | 2/N | 12.5 | 0-2 | 12.5 | 2 |
| 3-0 | 20 | 2-2 | 14.5 | 1/2 | 22 | |
| 2/1 | 20 | 3-3 | 51 | 0-3 | 29 | |
| 3-2 | 30 | | | 2-3 | 32 | |
| 4-2 | 56 | | | 2-4 | 76 | |

| | |
|---|---|
| Number of paths (max) | 640000 |
| Min odds | 1000 |
| Max odds | 5000 |
| Number of paths found | 1605 |
| Index of path to draw | all |

Compute paths

Paths List

| id | node1 | node2 | node3 | node4 | node5 | node6 | Odd |
|---|---|---|---|---|---|---|---|
| 0 | 1 1/1 | 1 1/1 | 1 1 | N N | N N | 2 2 | 1024.7737499999998 |
| 1 | 1 1 | 1 1/1 | 1 1/1 | N N | N N | 2 2 | 1024.77375 |
| 2 | 1 1/1 | 1 1 | 1 1/1 | N N | N N | 2 2 | 1024.77375 |

- Group 1000/1 - 5000/1

| Home | win odds | Draw | odds | Away | win odds | Results order |
|---|---|---|---|---|---|---|
| 1 | 2.40 | N | 3.25 | 2 | 3.3 | 1 |
| 1/1 | 3.5 | N/N | 4.1 | 2/2 | 4.6 | 1 |
| N/1 | 5.25 | 1-1 | 6 | N/2 | 6.25 | 1 |
| 1-0 | 6.5 | 0-0 | 7.25 | 0-1 | 7.5 | N |
| 2-0 | 9.5 | 1/N | 12.5 | 1-2 | 10.5 | N |
| 2-1 | 9 | 2/N | 12.5 | 0-2 | 12.5 | 2 |
| 3-0 | 20 | 2-2 | 14.5 | 1/2 | 22 | |
| 2/1 | 20 | 3-3 | 51 | 0-3 | 29 | |
| 3-2 | 30 | | | 2-3 | 32 | |
| 4-2 | 56 | | | 2-4 | 76 | |

| | |
|---|---|
| Number of paths (max) | 640000 |
| Min odds | 5000 |
| Max odds | 10000 |
| Number of paths found | 3836 |
| Index of path to draw | all |

Compute paths

Paths List

| id | node1 | node2 | node3 | node4 | node5 | node6 | Odd |
|---|---|---|---|---|---|---|---|
| 0 | 1 N/1 | 1 1/1 | 1 1/1 | N N | N 0-0 | 2 2 | 5000.698828125 |
| 1 | 1 1/1 | 1 N/1 | 1 1/1 | N 0-0 | N N | 2 2 | 5000.698828125 |
| 2 | 1 1/1 | 1 1/1 | 1 N/1 | N N | N 0-0 | 2 2 | 5000.698828125 |

• Group 5000/1 - 10000/1

| Home | win odds | Draw | odds | Away | win odds | Results order |
|---|---|---|---|---|---|---|
| 1 | 2.40 | N | 3.25 | 2 | 3.3 | 1 |
| 1/1 | 3.5 | N/N | 4.1 | 2/2 | 4.6 | 1 |
| N/1 | 5.25 | 1-1 | 6 | N/2 | 6.25 | 1 |
| 1-0 | 6.5 | 0-0 | 7.25 | 0-1 | 7.5 | N |
| 2-0 | 9.5 | 1/N | 12.5 | 1-2 | 10.5 | N |
| 2-1 | 9 | 2/N | 12.5 | 0-2 | 12.5 | 2 |
| 3-0 | 20 | 2-2 | 14.5 | 1/2 | 22 | |
| 2/1 | 20 | 3-3 | 51 | 0-3 | 29 | |
| 3-2 | 30 | | | 2-3 | 32 | |
| 4-2 | 56 | | | 2-4 | 76 | |

| | |
|---|---|
| Number of paths (max) | 640000 |
| Min odds | 10000 |
| Max odds | 25000 |
| Number of paths found | 13766 |
| Index of path to draw | all |

Compute paths

Paths List

| id | node1 | node2 | node3 | node4 | node5 | node6 | Odd |
|---|---|---|---|---|---|---|---|
| 0 | 1 1/1 | 1 N/1 | 1 1/1 | N N | N 2-2 | 2 2 | 10001.39765625 |
| 1 | 1 1/1 | 1 1/1 | 1 N/1 | N N | N 2-2 | 2 2 | 10001.39765625 |
| 2 | 1 1/1 | 1 1/1 | 1 N/1 | N 2-2 | N N | 2 2 | 10001.39765625 |

• Group 10000/1 - 25000/1

| Home | win odds | Draw | odds | Away | win odds | Results order |
|---|---|---|---|---|---|---|
| 1 | 2.40 | N | 3.25 | 2 | 3.3 | 1 |
| 1/1 | 3.5 | N/N | 4.1 | 2/2 | 4.6 | 1 |
| N/1 | 5.25 | 1-1 | 6 | N/2 | 6.25 | 1 |
| 1-0 | 6.5 | 0-0 | 7.25 | 0-1 | 7.5 | N |
| 2-0 | 9.5 | 1/N | 12.5 | 1-2 | 10.5 | N |
| 2-1 | 9 | 2/N | 12.5 | 0-2 | 12.5 | 2 |
| 3-0 | 20 | 2-2 | 14.5 | 1/2 | 22 | |
| 2/1 | 20 | 3-3 | 51 | 0-3 | 29 | |
| 3-2 | 30 | | | 2-3 | 32 | |
| 4-2 | 56 | | | 2-4 | 76 | |

| | |
|---|---|
| Number of paths (max) | 640000 |
| Min odds | 25000 |
| Max odds | 50000 |
| Number of paths found | 21229 |
| Index of path to draw | all |

Compute paths

Paths List

| id | node1 | node2 | node3 | node4 | node5 | node6 | Odd |
|---|---|---|---|---|---|---|---|
| 0 | 1 N/1 | 1 1 | 1 N/1 | N 1-1 | N 1-1 | 2 1-2 | 25004.699999999997 |
| 1 | 1 N/1 | 1 N/1 | 1 1 | N 1-1 | N 1-1 | 2 1-2 | 25004.699999999997 |
| 2 | 1 1 | 1 N/1 | 1 N/1 | N 1-1 | N 1-1 | 2 1-2 | 25004.699999999997 |

• Group 25000/1 - 50000/1

Enter your values

| Home | win odds | Draw | odds | Away | win odds | Results order |
|---|---|---|---|---|---|---|
| 1 | 2.40 | N | 3.25 | 2 | 3.3 | 1 |
| 1/1 | 3.5 | N/N | 4.1 | 2/2 | 4.6 | 1 |
| N/1 | 5.25 | 1-1 | 6 | N/2 | 6.25 | 1 |
| 1-0 | 6.5 | 0-0 | 7.25 | 0-1 | 7.5 | N |
| 2-0 | 9.5 | 1/N | 12.5 | 1-2 | 10.5 | N |
| 2-1 | 9 | 2/N | 12.5 | 0-2 | 12.5 | 2 |
| 3-0 | 20 | 2-2 | 14.5 | 1/2 | 22 | |
| 2/1 | 20 | 3-3 | 51 | 0-3 | 29 | |
| 3-2 | 30 | | | 2-3 | 32 | |
| 4-2 | 56 | | | 2-4 | 76 | |

| | |
|---|---|
| Number of paths (max) | 640000 |
| Min odds | 50000 |
| Max odds | 100000 |
| Number of paths found | 35139 |
| Index of path to draw | all |

Compute paths

Paths List

| id | node1 | node2 | node3 | node4 | node5 | node6 | Odd |
|---|---|---|---|---|---|---|---|
| 0 | 1 1/1 | 1 1/1 | 1 1 | N 0-0 | N 3-3 | 2 2/2 | 50004-99 |
| 1 | 1 1 | 1 1/1 | 1 1/1 | N 0-0 | N 3-3 | 2 2/2 | 50004-99 |
| 2 | 1 1/1 | 1 1 | 1 1/1 | N 0-0 | N 3-3 | 2 2/2 | 50004-99 |

• Group 50000/1 - 100000/1

Enter your values

| Home | win odds | Draw | odds | Away | win odds |
|---|---|---|---|---|---|
| 1 | 2.40 | N | 3.25 | 2 | 3.3 |
| 1/1 | 3.5 | N/N | 4.1 | 2/2 | 4.6 |
| N/1 | 5.25 | 1-1 | 6 | N/2 | 6.25 |
| 1-0 | 6.5 | 0-0 | 7.25 | 0-1 | 7.5 |
| 2-0 | 9.5 | 1/N | 12.5 | 1-2 | 10.5 |
| 2-1 | 9 | 2/N | 12.5 | 0-2 | 12.5 |
| 3-0 | 20 | 2-2 | 14.5 | 1/2 | 22 |
| 2/1 | 20 | 3-3 | 51 | 0-3 | 29 |
| 3-2 | 30 | | | 2-3 | 32 |
| 4-2 | 56 | | | 2-4 | 76 |

Results order 1
1
1
N
N
2

| | |
|---|---|
| Number of paths (max) | 640000 |
| Min odds | 100000 |
| Max odds | 250000 |
| Number of paths found | 69386 |
| Index of path to draw | all |

Compute paths

Paths List

| id | node1 | node2 | node3 | node4 | node5 | node6 | Odd |
|---|---|---|---|---|---|---|---|
| 0 | 1 1/1 | 1 1 | 1 1/1 | N 2-2 | N 3-3 | 2 2/2 | 100009.98 |
| 1 | 1 1/1 | 1 1/1 | 1 1 | N 3-3 | N 2-2 | 2 2/2 | 100009.98 |
| 2 | 1 1 | 1 1/1 | 1 1/1 | N 2-2 | N 3-3 | 2 2/2 | 100009.98 |

• Group 100000/1 - 250000/1

| Home | win odds | Draw | odds | Away | win odds | Results order |
|---|---|---|---|---|---|---|
| 1 | 2.40 | N | 3.25 | 2 | 3.3 | 1 |
| 1/1 | 3.5 | N/N | 4.1 | 2/2 | 4.6 | 1 |
| N/1 | 5.25 | 1-1 | 6 | N/2 | 6.25 | 1 |
| 1-0 | 6.5 | 0-0 | 7.25 | 0-1 | 7.5 | N |
| 2-0 | 9.5 | 1/N | 12.5 | 1-2 | 10.5 | N |
| 2-1 | 9 | 2/N | 12.5 | 0-2 | 12.5 | 2 |
| 3-0 | 20 | 2-2 | 14.5 | 1/2 | 22 | |
| 2/1 | 20 | 3-3 | 51 | 0-3 | 29 | |
| 3-2 | 30 | | | 2-3 | 32 | |
| 4-2 | 56 | | | 2-4 | 76 | |

| | |
|---|---|
| Number of paths (max) | 640000 |
| Min odds | 250000 |
| Max odds | 500000 |
| Number of paths found | 67791 |
| Index of path to draw | all |

Compute paths

Paths List

| id | node1 | node2 | node3 | node4 | node5 | node6 | Odd |
|---|---|---|---|---|---|---|---|
| 0 | 1 3-0 | 1 2-1 | 1 2-0 | N N | N 1-1 | 2 0-1 | 250087.5 |
| 1 | 1 2-0 | 1 2-1 | 1 2/1 | N 1-1 | N N | 2 0-1 | 250087.5 |
| 2 | 1 2-1 | 1 3-0 | 1 2-0 | N N | N 1-1 | 2 0-1 | 250087.5 |

• Group 250000/1 - 500000/1

| Home | win odds | Draw | odds | Away | win odds | Results order |
|---|---|---|---|---|---|---|
| 1 | 2.40 | N | 3.25 | 2 | 3.3 | 1 |
| 1/1 | 3.5 | N/N | 4.1 | 2/2 | 4.6 | 1 |
| N/1 | 5.25 | 1-1 | 6 | N/2 | 6.25 | 1 |
| 1-0 | 6.5 | 0-0 | 7.25 | 0-1 | 7.5 | N |
| 2-0 | 9.5 | 1/N | 12.5 | 1-2 | 10.5 | N |
| 2-1 | 9 | 2/N | 12.5 | 0-2 | 12.5 | 2 |
| 3-0 | 20 | 2-2 | 14.5 | 1/2 | 22 | |
| 2/1 | 20 | 3-3 | 51 | 0-3 | 29 | |
| 3-2 | 30 | | | 2-3 | 32 | |
| 4-2 | 56 | | | 2-4 | 76 | |

| | |
|---|---|
| Number of paths (max) | 640000 |
| Min odds | 0 |
| Max odds | 1000000 |
| Number of paths found | 3000 |
| Index of path to draw | all |

Compute paths

Paths List

| id | node1 | node2 | node3 | node4 | node5 | node6 | Odd |
|---|---|---|---|---|---|---|---|
| 0 | 1 1 | 1 1 | 1 1 | N N | N N | 2 2 | 481.85279999999995 |
| 1 | 1 1 | 1 1 | 1 1 | N N/N | N N | 2 2 | 607.8758399999999 |
| 2 | 1 1 | 1 1 | 1 1 | N N | N N/N | 2 2 | 607.8758399999999 |

• Group 500000/1 - 1000000/1

COMPUTER SYSTEM FOR ENABLING PLACEMENT OF WAGERS

The present invention relates generally to a computer system for enabling placement of wagers and finds particular, although not exclusive, utility in betting on sports fixtures. In order to place a wager, it is useful to know the odds of an event occurring prior to the placement of the wager. In simple circumstances, such as when placing a bet on the result of a specific game, the odds are easily established. However, for certain types of wager, for example accumulation wagers and other associated types, it can be difficult and time-consuming to determine the odds for any particular wager. More particularly, users will often want to calculate odds for a variety of combinations of events to establish a favourable/desired amount of risk in order to place a wager. Regrettably, odds produced by bookmakers often change with sufficient frequency that it is not possible for a user to calculate all the possible odds for a variety of combinations of events before the odds produced by a bookmaker change, thus invalidating their calculations.

According to a first aspect of the present invention, there is provided a computer system for enabling placement of wagers, the computer system comprising a processor configured to: receive respective odds of each of a plurality of outcomes of each of a plurality of events from a bookmaker, wherein each of the plurality of outcomes comprises one of a plurality of outcome types; present a list comprising a respective indication of each of the plurality of events to a user, wherein the list comprises a number of the respective indications; in response to receiving an input from the user, define a further list comprising a plurality of selected outcome types chosen from the plurality of outcome types, wherein the further list comprises a further number of the selected outcome types equal to the number of the respective indications; calculate a plurality of combined odds, wherein each combined odds of the plurality of combined odds comprises a respective combination of each respective indication of each of the plurality of events with a corresponding one of the selected outcome types; present the plurality of combined odds to the user in the form of a visual display; in response to receiving a choice from a user, choose a respective one of the plurality of combined odds; and produce a contract based on the respective one of the plurality of combined odds.

In this way, users may place combination wagers on the outcomes of a combination of events in an informed manner; that is, being aware of the combined odds and alternative combined odds available.

The computer system may comprise a general-purpose computer, server, smartphone, tablet, phablet, personal computer, etc. The computer system may be real or virtual.

The processor may comprise a conventional computer processor and/or controller. The processor may be real or virtual. The processor may comprise a plurality of sub-processors.

The processor being configured to operate in a particular manner may comprise the processor being programmed to operate in that particular manner, either in software or in hardware. For instance, via a stored application.

Receiving respective odds may comprise having odds sent to the computer system and/or the computer system requesting the odds over the internet, cellular network, or any other communication network, for instance via modem or some other transceiver/transmitter/receiver.

Each event may comprise, for example, a race, a competition, a game, etc. Each event may be of a similar type (e.g. all games, or all the same type of sports game, but between different teams and/or at different times). Each event may have a variety of outcomes, for example a win, lose and/or draw for one team in a competition, a first, second, third, finish, etc. for a competitor in a race, etc.

The plurality of outcomes may comprise only two, at least two and/or more than two outcomes, for example, three, four, five or six outcomes.

A bookmaker may provide odds for each outcome, or only some outcomes. For example, a bookmaker may provide first odds for a win, second odds for a draw and third odds for a loss by a particular team in a game (e.g. an association football game, or other sports competition). The odds of a win, lose or draw may add up to 1 in line with conventional laws of probability; however, more usually this is not the case. The bookmaker may be an external organisation and/or company. The bookmaker may be a third-party unrelated to the computer system host. Data comprising the respective odds may be provided via an application program interface (API) or other suitable mechanism.

Outcome types may comprise outcomes such as wins, looses, draws, first place, second place, third place, finish, etc.

The processor may be further configured to, in response to receiving a selection from the user, select the plurality of events from a set of possible events. That is, the processor may be configured to: receive respective odds of each of a plurality of outcomes of each of a set of possible events from a bookmaker, wherein each of the plurality of outcomes comprises one of a plurality of outcome types; present each of the set of possible events to a user; in response to receiving a selection from the user, select a plurality of events from the set of possible events; and present a list comprising a respective indication of each of the plurality of events to the user, wherein the list comprises a number of the respective indications.

The plurality of events may comprise only two, at least two and/or more than two outcomes, for example up to three, three, at least three, up to four, four, at least four, up to five, five, at least five, up to six, six, at least six, up to seven, seven, and/or at least seven outcomes.

The processor may be configured to accept additional input from the user, and/or operator, to set and/or limit the number of the plurality of events to a specific number, to set the type of event (e.g. sport, race, league, etc.), to limit the events to a specific subset of events, and/or to set and/or limit the possible outcomes and/or outcome types in question. Alternatively or additionally, such settings/limits may be generated randomly/pseudo-randomly by the computer system and/or processor.

Presenting the list may comprise presenting the list visually, for example on a monitor and/or screen.

The indications may comprise a name, designation, location, event-type and/or time of the event.

An input from a user may comprise selection of options, for example by contact with a touch screen or clicking a mouse.

In the case where the plurality of outcome types are win, lose and draw, and where there are for instance six respective indications of events, the selected outcome types may be for example two wins, three loses and one draw. In this example, a first combined odds may be odds for winning the first game, winning the second game, losing the third game, losing the fourth game, losing the fifth game and draw the sixth game. Similarly, a second combined odds may be odds for draw the first game, winning the second game, losing the third game, losing the fourth game, losing the fifth game and winning the sixth game. Further combined odds may be calculated in a similar way for all other combinations of indications of events and selected outcome types. By way of illustration, if six wins are selected, then there would only be one combined odds calculated. The processor being configured to calculate a plurality of combined odds may comprise the processor being configured to calculate a single combined odds, where appropriate.

Similarly, the selected outcome types may be for example one win, one lose and four draws, etc. The skilled person would find it apparent that other outcome types, other numbers of indications, and other selected outcome types would work in a similar manner.

The visual display may comprise a graphical representation, for example an image, e.g. a wheel.

The processor being configured to present the plurality of combined odds to a user may comprise: the processor being configured to automatically select a subset of the plurality of combined odds, wherein each of the plurality of combined odds comprise a respective value over a range of values, the subset comprising a plurality of values equally distributed over the range of values; and the processor being configured to present the subset of the plurality of combined odds to the user in the form of the visual display.

The plurality of values being equally distributed may comprise the plurality of values being equally spaced (to within 1%, 5%, 10%, 20%, 25% and/or 33% tolerance), the plurality of values extending over the entire range of values (to within 1%, 5%, 10%, 20%, 25% and/or 33% tolerance), and/or at least one value of the plurality of values being within a predetermined/predefined bin-size within the range of values. For example, a first bin may be for odds between 1000 to 1 and 5000 to 1, a second bin may be for odds between 5000 to 1 and 10000 to 1, a third bin may be for odds between 10000 to 1 and 25000 to 1, etc. These bins may be termed 'groups', there may be only/at least two, three, four, five, six, seven, eight, nine, ten or more bins/groups.

The selection of the plurality of values may be random/pseudorandom.

A user or operator may set bin sizes and/or ranges, and/or a maximum and/or minimum risk to be incurred.

A user or operator may set a maximum and/or minimum exposure of the user to loss.

Producing a contract may comprise the user and the operator of the computer system and/or bookmaker entering into a legal agreement to place a wager for a fixed amount at a specific time. In particular, the contract may essentially place the wager in real time using the respective odds supplied by the bookmaker at that time that generated the chosen combined odds.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

FIG. 4 to FIG. 13 show detail of each segment shown in FIG. 3.

Figure 1:
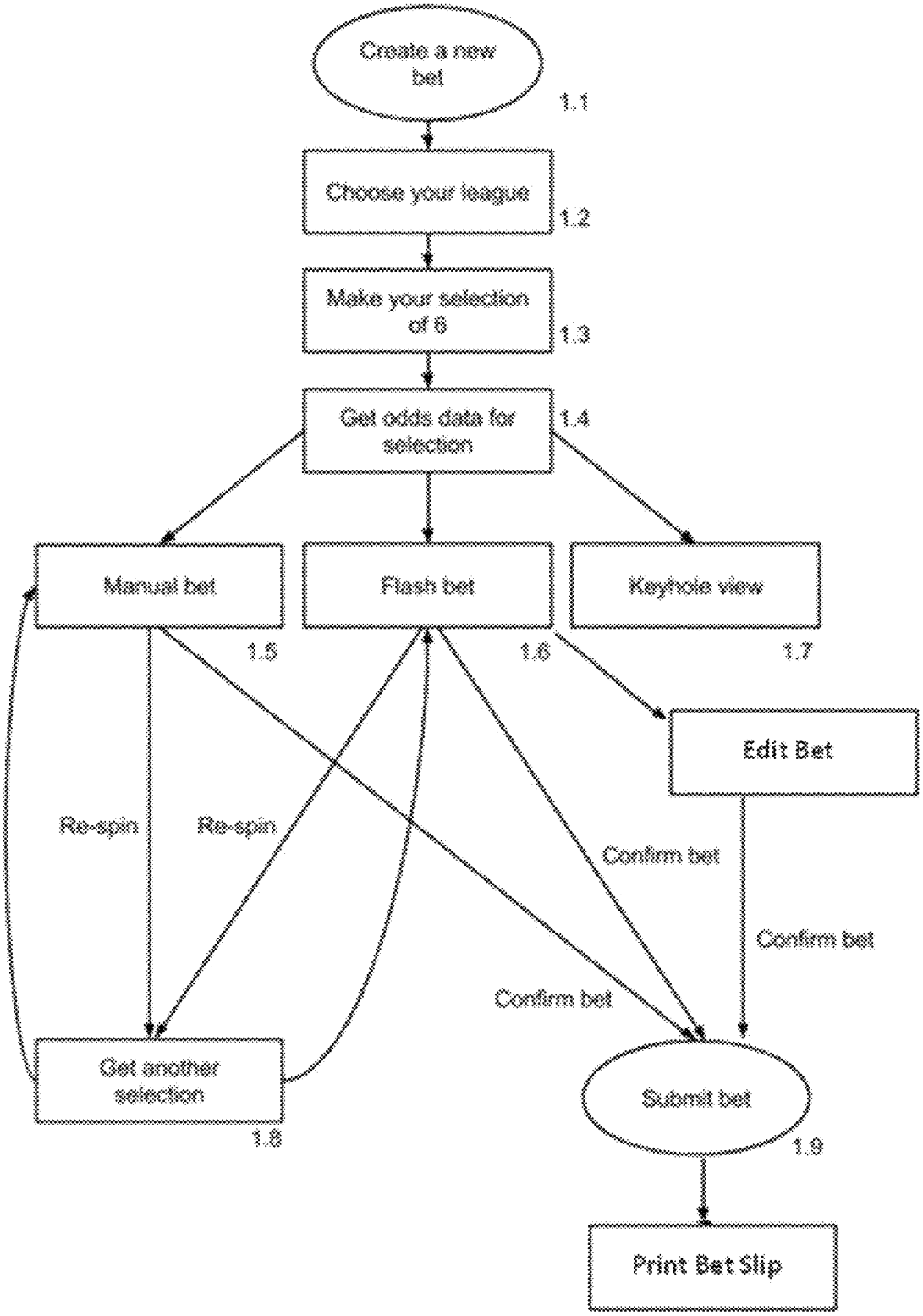
FIG. 1 shows the general steps of the (Flash Bet App) application.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein. Likewise, method steps described or claimed in a particular sequence may be understood to operate in a different sequence.

Moreover, the terms top, bottom, over, under and the like in the description and the claims are used for descriptive purposes and not necessarily for describing relative positions.

It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "connected", used in the description, should not be interpreted as being restricted to direct connections only. Thus, the scope of the expression "a device A connected to a device B" should not be limited to devices or systems wherein an output of device A is directly connected to an input of device B. It means that there exists a path between an output of A and an input of B which may be a path including other devices or means. "Connected" may mean that two or more elements are either in direct physical or electrical contact, or that two or more elements are not in direct contact with each other but yet still co-operate or interact with each other. For instance, wireless connectivity is contemplated.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects.

Furthermore, the particular features, structures or characteristics of any one embodiment or aspect of the invention may be combined in any suitable manner with any other particular feature, structure or characteristic of another embodiment or aspect of the invention, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances. The use of the term "any" may mean "all" and/or "each" in certain circumstances. The principles of the invention will now be described by a detailed description of at least one drawing relating to exemplary features. It is clear that other arrangements can be configured according to the knowledge of persons skilled in the art without departing from the underlying concept or technical teaching, the invention being limited only by the terms of the appended claims.

The invention described below is an online betting system operated on a computerized device that utilizes a website available on either an open platform (i.e., World Wide Web; Internet) or a closed platform (i.e., Intranet) that allows users to connect directly to facilitate betting on a variety of football match outcomes. The App, as invented, can also be utilized in an affixed point play machine device as a fixed odds betting terminal (FOBT) which is an electromechanical device that allows players to bet on the outcome of various games and events with fixed odds.

The App is a betting application with 56 prefixed odds parameters operated on a computerized device for managing a combination of bets relating to outcomes of 6 football matches. The application developed is an automated betting system which is programmed to calculate random groups of 6 selections drawn from between 8-10 specific odds groups, per match, from the 56 odds selections in total, in real time, on a chronometric dial ("bet wheel").

The FlashBet option is the name given to the selection of 10 different odds groups of 6 produced in an instant by the algorithm, it allows for 10 units (currency) to be spread evenly over 10 bet slips each of which is a function of the user's initial selections. This saves the user time and trouble to achieve what the user could not achieve without the support of the App.

The App (FlashBet) allows a bet (wager) to be placed primarily on the user's own selections, represented by the minimum odds group, which once made are subsequently arranged into 9 other odds groups. In the FlashBet scenario the stake is spread evenly over the 10 odds groups categories, which optimise their propensity to win with significant percentage gain.

In the manual bet option, the user has the benefit of being able to "re-spin" the bet wheel "ad infinitum" this enables the user to choose from a completely new group of 10 odds groups of 6, each time the user re-spins the wheel. In addition to this (unlike the FlashBet option) the user can specify and vary the amount they wish to bet (wager) on each of the separate odds groups represented by the 10 segments on the bet wheel. If the user wishes they can choose any segment from the odds groups between 1 and 10 as represented on the bet wheel.

The App is in the form of a chronometric dial (bet wheel) and allows a user to efficiently place a bet (wager) on their own selections, which sorts a series of odds groups selections based on a programme running a series of algorithms which compare groups of outcomes/results over years of historical data in football. The App adopted by way of a chart data interface divided into "The Grid" based on the greater percentage outcomes of historical results. (can be adapted for other sports).

The present invention described with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete enough to fully convey the scope of the invention to those skilled in the art of betting.

Those of ordinary skill in the art familiar with betting should be aware that the following descriptions of the embodiments of the present invention are illustrative and are not intended to be limiting in any way. Other embodiments of the present invention will readily suggest themselves to such skilled persons having the benefit of this disclosure.

FIG. 1 shows the general steps of the (Flash Bet App) application.

1.1: Create a new bet. Start of the application.

1.2: Choose your league among a list (Premier League, Bundesliga German, Liga Spain, Italy Serie A, France Ligue 1, and so forth.

1.3: Choose 6 matches in the chosen league and pick 3 Home wins, 2 Draws and 1 away win.

1.4: In this step, the program will find odds for your selection in real-time. And use the algorithm described in FIG. 2 to suggest to user various 6-fold selections which belong to different groups of odds values. Starting at Minimum to 1 odds.

1.5: Manual bet. This mode allows you to bet any amount on any selection.

1.6: Flash bet. This mode allows you to automatically bet £10 on selections (£1 for each).

1.7: Keyhole view. This mode allows you to take a magnified look on the selection's odds.

1.8: Your selection is not good for you, change it. Allows user to edit bet.

1.9: Submit your bet.

Re-Spin: Change your group of 6-fold selections.

Figure 2:
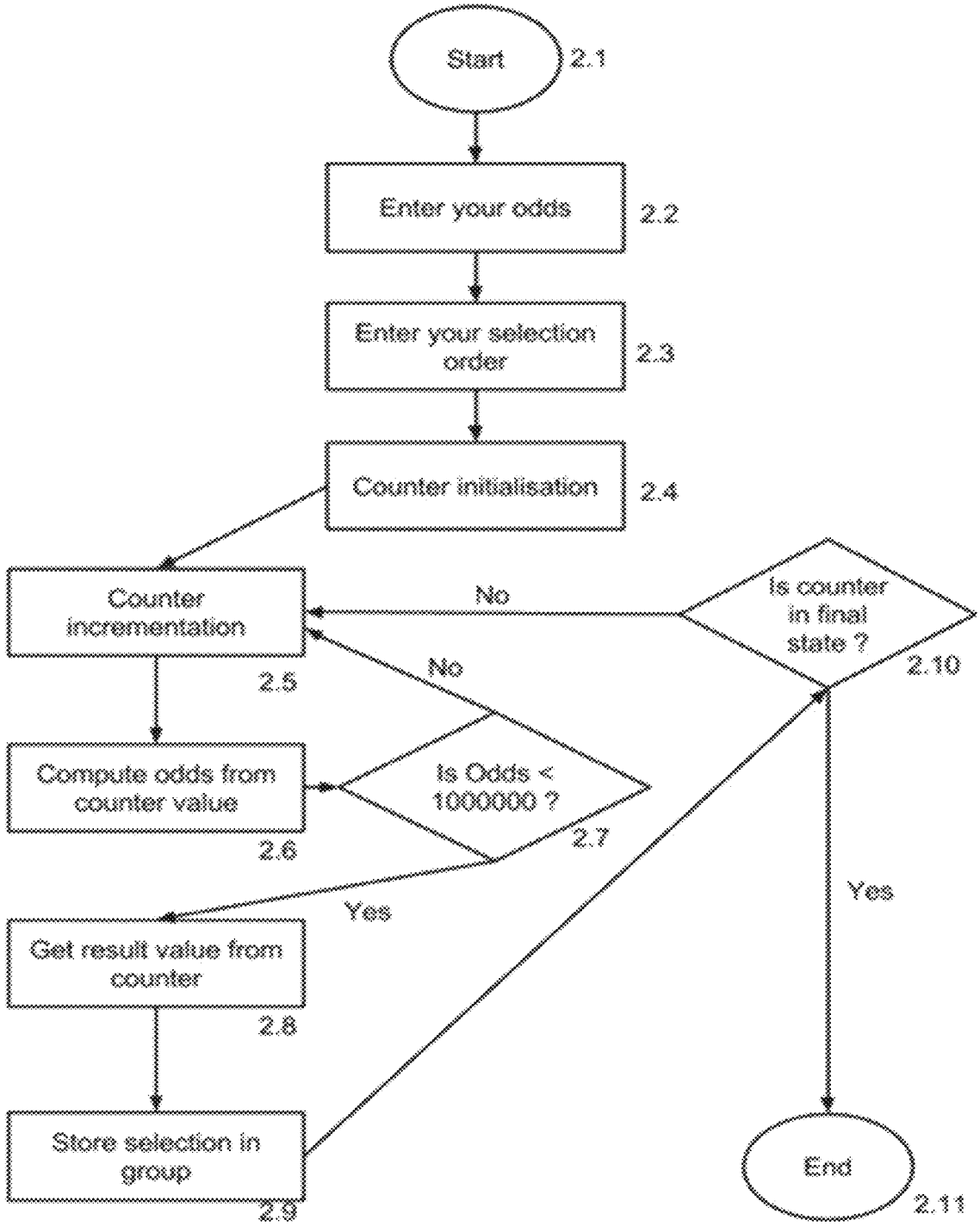
FIG. 2 shows the algorithm computing all selections that the FlashBet application uses.

FIG. 2 shows the algorithm computing all selections that the FlashBet application uses. All selections odds are under 1000000 and stored into different groups.

Groups (odds): Starting from minimum to 1

Group 1: 1000-5000

Group 2: 5000-10000

Group 3: 10000-25000

Group 4: 25000-50000

Group 5: 50000-100000

Group 6: 100000-250000

Group 7: 250000-50000

Group 8: 500000-1000000

2.1: Start of the algorithm.

2.2: Enter your odds value for the 6-fold chosen.

2.3: Enter your order for your 6-fold selection (example: 1 Home win, 1 Home win, 1 Home win, 1 Draw, 1 Draw, 1 Away win.

2.4: The algorithm uses a counter which is a permutation of a result array to compute odds from the 6-fold. This counter is initialized to 000000.

2.5: Get the next selection of 6-fold by incrementing the counter.

2.6: Get the corresponding odds from the counter and compute the odds of the 6-fold.

2.7: The odds of the 6-fold is under 1000000. Go to 2.8, else go to 2.5.

2.8: Get the corresponding result from counter.

2.9: Store the selection in the corresponding group of odds.

2.10: The counter is in final state? Go to 2.11, else go to 2.5. The counter starts from 000000 and goes to 999779 the 9 matches the results for Home wins and away wins, and 7 matches the results for draw matches.

2.11: The end of the algorithm.

The App may be set up to illuminate common odds groups based on the historical results. The historical data groups being symmetrically matched with future football fixtures and matched with the 56 odds groups according to the bet wheel grid.

Figure 3:
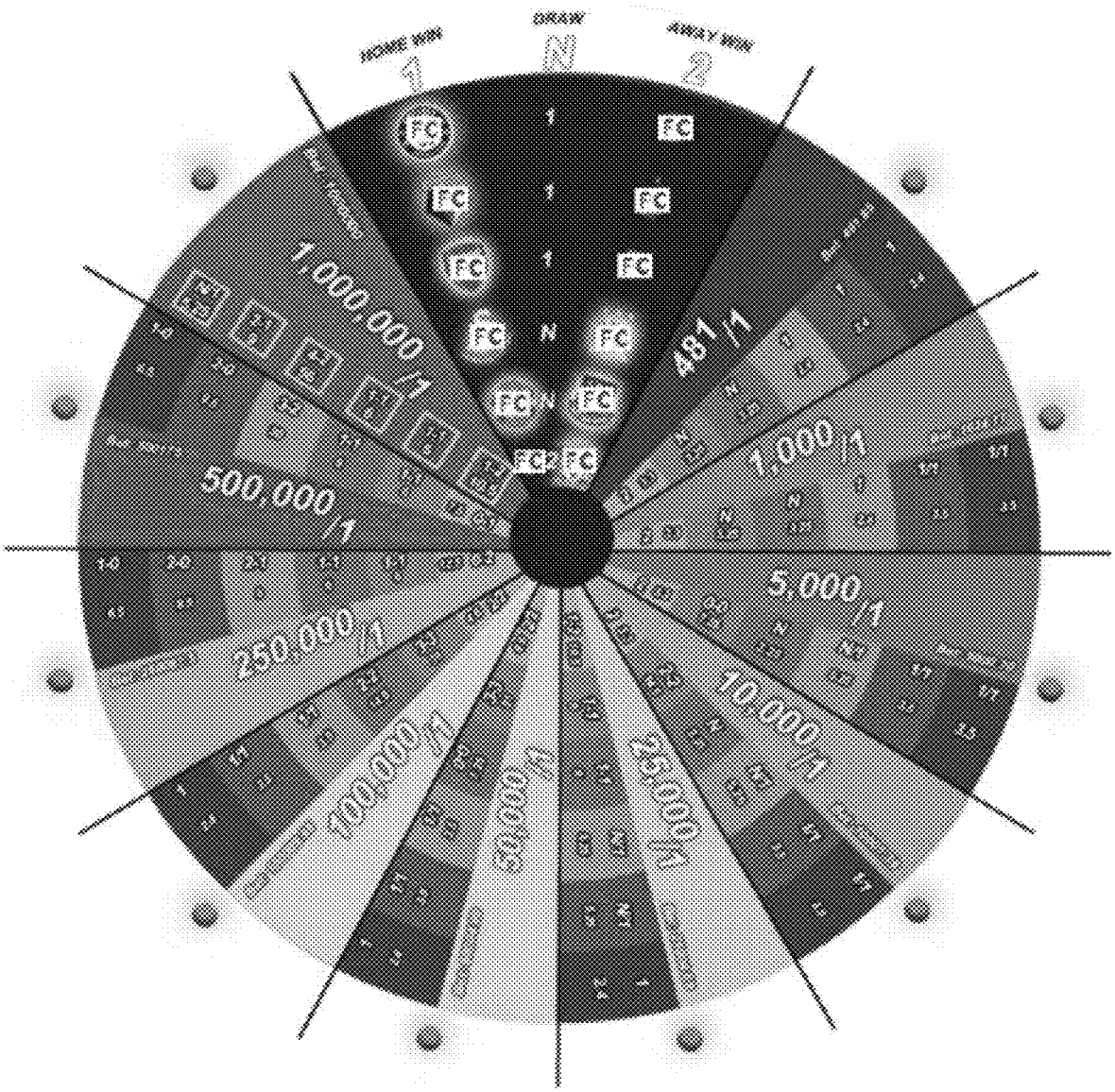
FIG. 3 shows an illustrative schematic form which depicts some of the pathways that may be used in the Flash Bet App.
Figure 14:
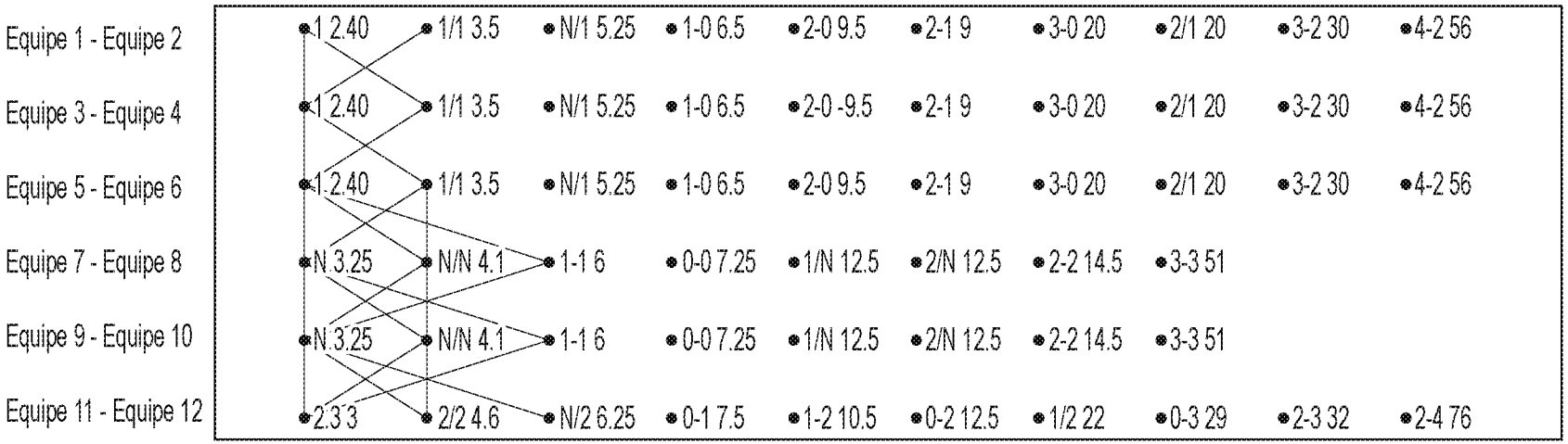
FIG. 14 to FIG. 22 are other selected charts showing multiple pathways as used in the algorithm.
Figure 15:
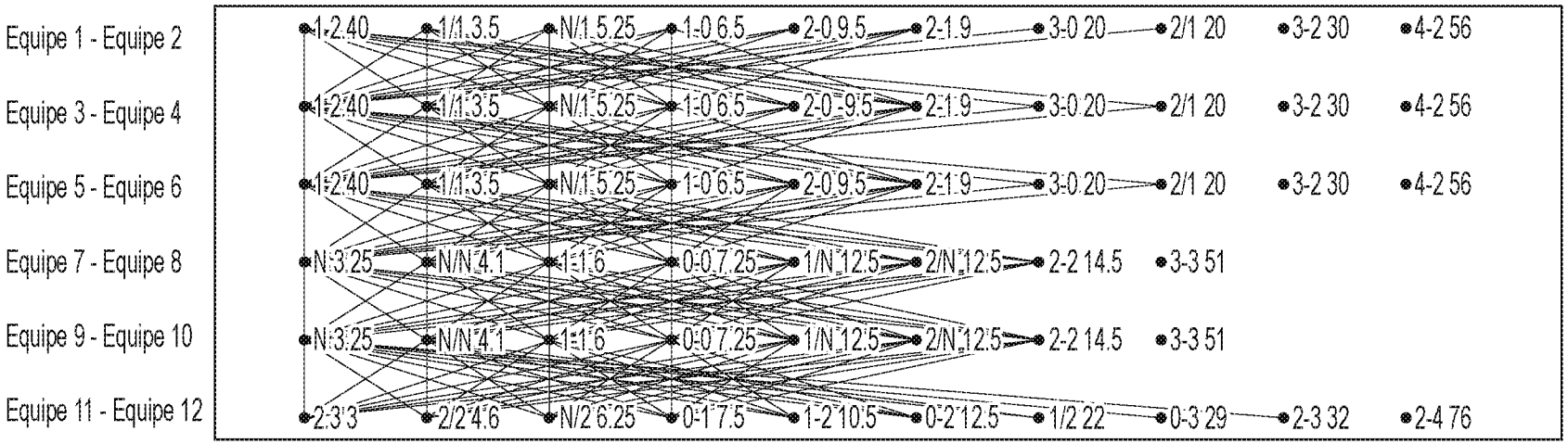
Figure 16:
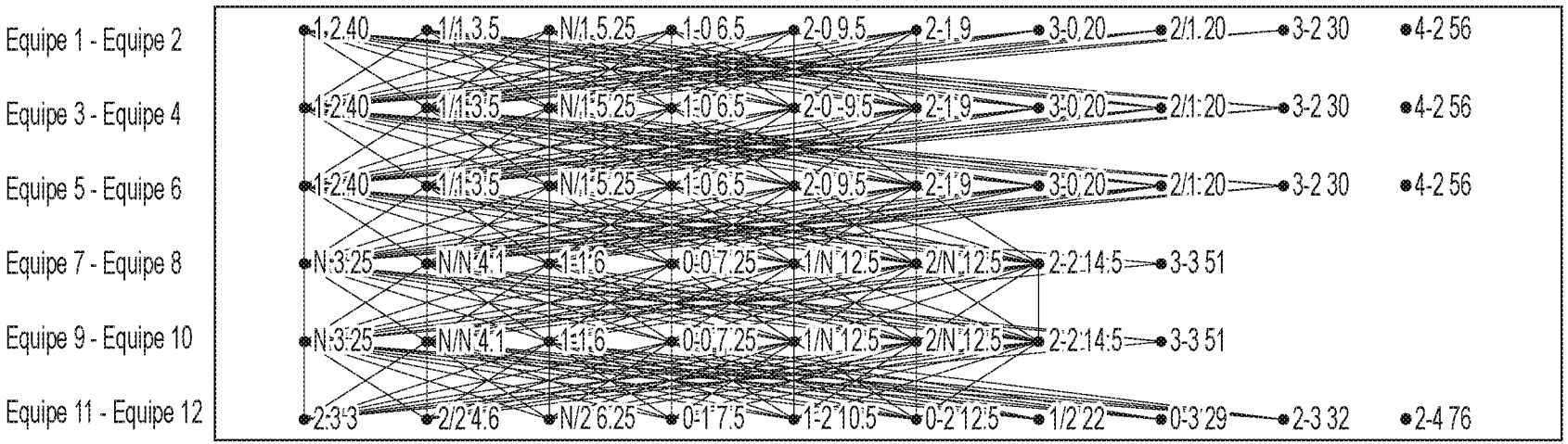
Figure 17:
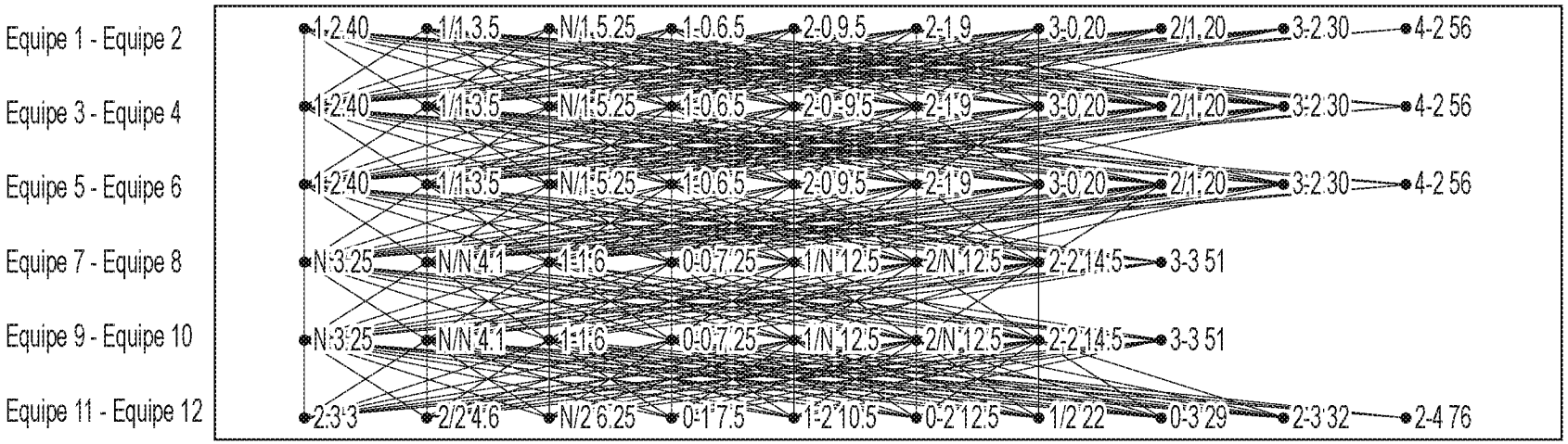
Figure 18:
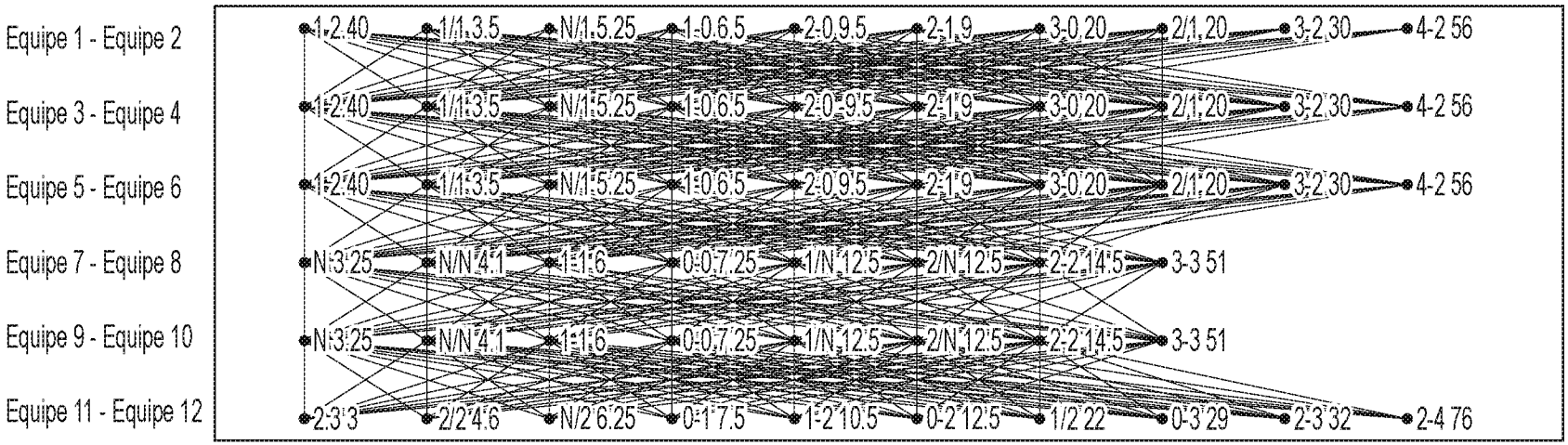
Figure 19:
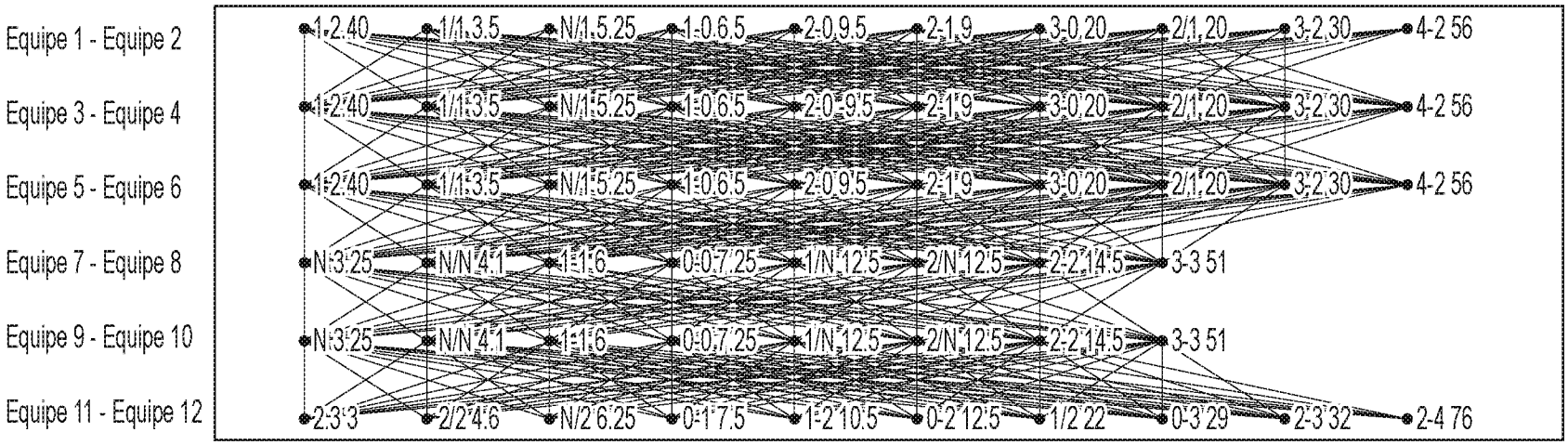
Figure 20:
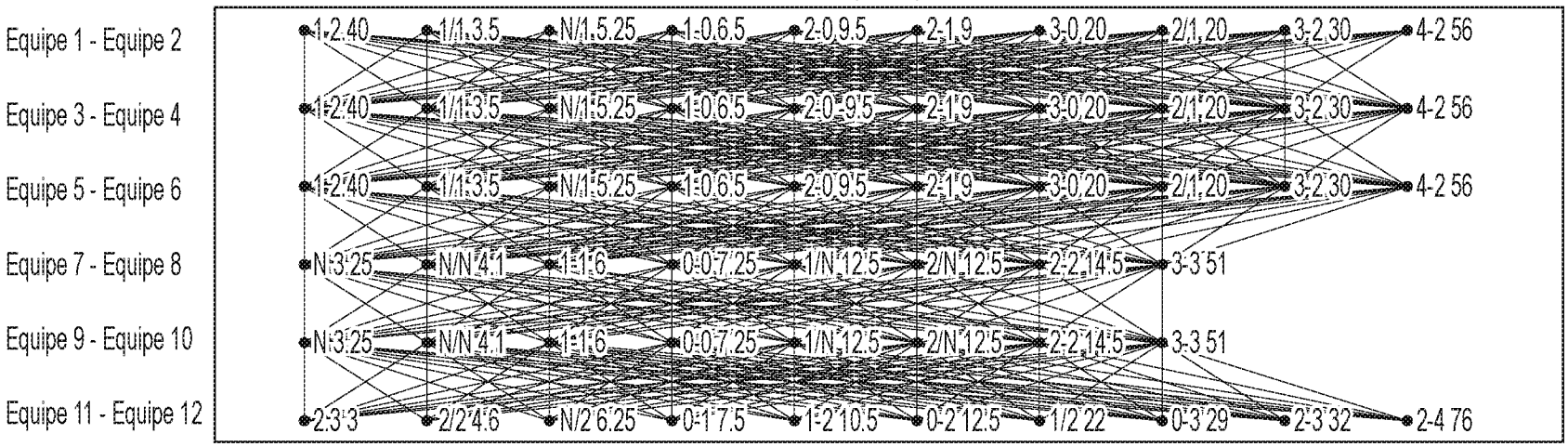
Figure 21:
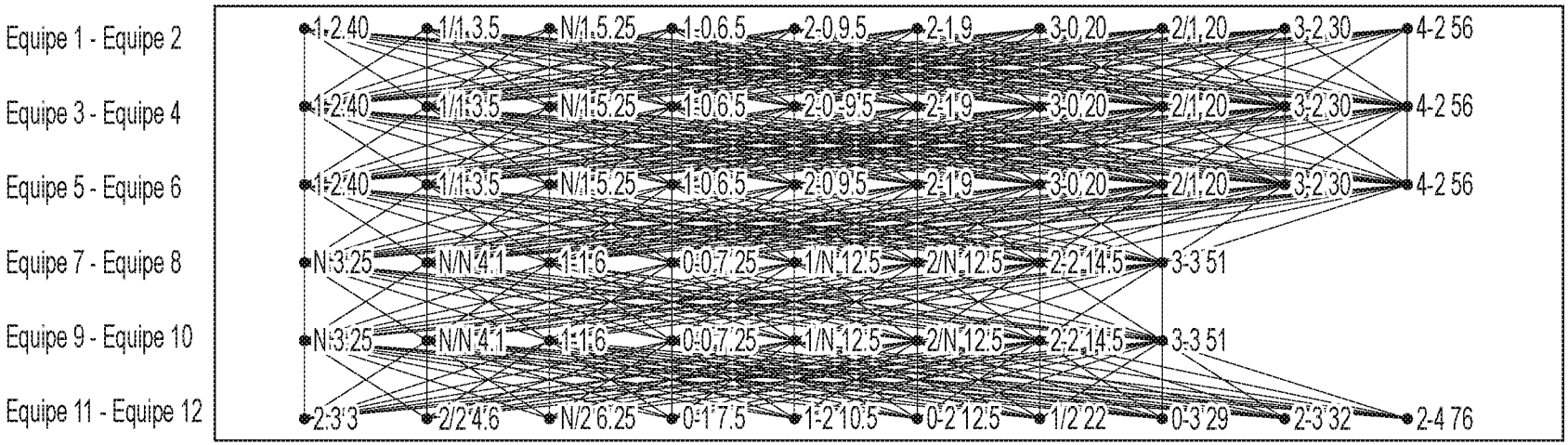
Figure 22:
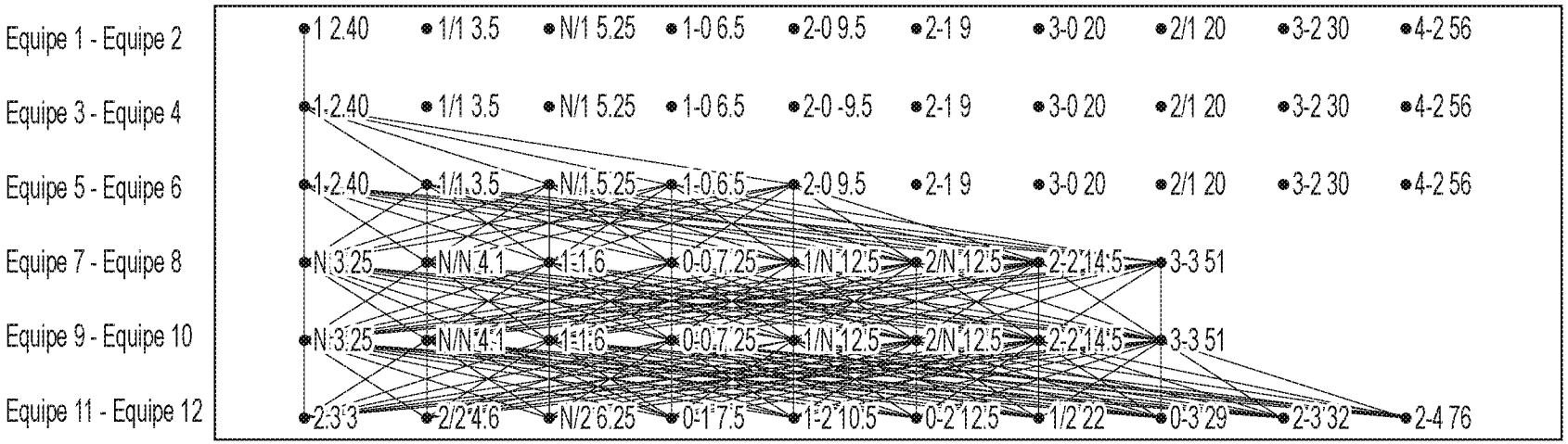

Referring to FIG. 3, the App sets out in a chronometric dial (bet wheel) format the schematic for the application, the 111NN2 column (as shown in charts) is to be depicted by football team names. The user is required to make their selections before initiating the spinning of the bet wheel enabling the user to view and if desirable to select the 10 initial odds groups of 6 (in the FlashBet scenario).

The user ultimately has the opportunity of placing a bet on the options supplied by the App and has the option of re-spinning the bet wheel until the user's desired selection is presented by the App.

As the user spins the dial, to the right you see the minimum odds represented by the App of the 6 matches and the teams selected, 3×Straight Win—2×Draws—1×Away Win called the minimum odds group.

Moving the chronometric dial (bet wheel) 2 Ticks, Tick Tick to the right towards 2 o'clock will give the min to 1,000 odds group and so on until you get around to one million, if the user wishes to change the provided groups of 6 the user can press re-spin and be given alternative odd groups in groups of six (not individually).

The software program ("FlashBet App") which has been developed into an online and mobile Application sorts ten 6-fold multiples in neat odds groups ranging from minimum odds to one million to one.

The FlashBet App betting system is programmed to calculate random groups of 6 selections drawn from 8-10 specific odds groups from 6 matches with 56 in total=The Grid, this is done in real time, from on a chronometric dial (bet clock). It allows a bet (wager) to be placed primarily on the user's own selections, which once made are subsequently arranged into odds groups, which optimise the user's propensity to win with significant percentage gains.

The application allows this to be done in a matter of seconds, saving the user both time and effort.

The application selections are sorted based on ALL TOTAL outcomes within the 56 referenced in The Grid. The programme runs a series of logarithms which compare outcome/results drawn from historical football match data.

The App is fast and exact in its dissemination of the odds groups categories offered to the user in the App, which can be re-spun if the user does not want to pick the first selection.

The App is set up to magnify frequent odds group patterns based on the historical results. Kick-Out . . . Kick-In data on a separate file.

The FlashBet mini wheel is a reduced version and an easier to use, it is a simplistic extension of the original FlashBet Wheel which involves 3 selections instead of 6 selections.

1 Home Win

1 Draw

1 Away Win

The application automatically produces the best odds for the standard "minimum" bet that is based purely on the outcomes chosen.

The algorithm behind the program throws out groups of 5×3 folds and arranges them in specific odds groups.

This App satisfies the growing desire by modern punters for rapid easy access to betting opportunities.

This App will be made available on all major platforms and for all major football soccer leagues and will allow betting opportunities across those leagues.

FIG. 3 shows an illustrative schematic form which depicts some of the pathways used in the Flash Bet App. The number of pathways is 640,000, the algorithm excludes over 50% of these as the combined odds are a multiple of 6 over 1,000,000 to 1 in the grid odds model provided in these cases.

In the usual weekend match fixtures, the App would calculate approximately 300,000 pathways of odds groups of 6 which pay under 1,000,000 to 1.

The User can use the same grid of (56 odds selections groups) to Service-Satisfy other variations including Single, Double, Treble, Four-Fold, Five-Fold and the existing Six-Fold Format.

The likely progressive step in the systems development is to create a mini wheel involving the same 56 odds selections groups but limiting the match selections to 3 (for example: One Home Win, One Draw, One Away Win).

In the example of 111NN2, where 1=Home Win, N=Draw, 2=Away Win, the (56 odds selections groups) have been arranged to Service-Satisfy as follows: Three Home Wins (1 Home Win, 1 Home Win, 1 Home Win), Two Draws (N Draw, N Draw), One Away Win (2 Away Win).

The chronometric dial ("bet wheel") as depicted serves as an example as to how the various pathways are displayed on the chronometric dial ("bet wheel") and as to how they are displayed as a whole and in segments.

The basic chronometric dial ("bet wheel") is divided in 10 opportunity selections to make a bet/wager.

The ten pathways of groups of 6 odds groups depicted convey just one of each odds groups categories represented by segments on the chronometric dial (Bet Clock) named FlashBet. The 10 pathways are set out into 10 segments and displayed on a chronometric dial ("bet wheel") as featured in the picture.

FIG. 4 to FIG. 13 show detail of each segment shown in FIG. 3.

FIG. 14 to FIG. 22 are other selected charts showing multiple pathways as used in the algorithm.

The invention claimed is:

1. A computer system for enabling placement of a wager, the computer system comprising a processor configured to:

receive respective odds of each of a plurality of outcomes of each of a plurality of events from a bookmaker, wherein each of the plurality of outcomes comprises one of a plurality of outcome types, wherein the plurality of outcomes comprises more than two outcomes, and wherein the plurality of events comprises at least six events;

present a list comprising a respective indication of each of the plurality of events to a user, wherein the list comprises a number of the respective indications;

in response to receiving an input from the user, define a further list comprising a plurality of selected outcome types chosen from the plurality of outcome types, wherein the further list comprises a further number of the selected outcome types equal to the number of the respective indications;

calculate a plurality of combined odds, wherein each combined odds of the plurality of combined odds comprises a respective combination of each respective indication of each of the plurality of events with a corresponding one of the selected outcome types;

present the plurality of combined odds to the user in the form of a visual display;

illuminate common odds groups within the plurality of combined odds, based on historical results;

in response to receiving a choice from a user, choose a respective one of the plurality of combined odds; and produce a contract based on the respective one of the plurality of combined odds, wherein the contract places the wager in real time using the respective one of the plurality of combined odds.

2. The computer system of claim 1, wherein the processor being configured to present the plurality of combined odds to a user comprises:

the processor being configured to automatically select a subset of the plurality of combined odds, wherein each of the plurality of combined odds comprise a respective value over a range of values, the subset comprising a plurality of values equally distributed over the range of values; and the processor being configured to present the subset of the plurality of combined odds to the user in the form of the visual display, wherein common odds groups within the plurality of combined odds are illuminated, based on historical results.

* * * * *